United States Patent [19]

Tait

[11] 4,005,859

[45] Feb. 1, 1977

[54] TRAINING DEVICE FOR ICE SKATERS

[75] Inventor: William Tait, Chelmsford, Canada

[73] Assignee: Lawrence Peska Associates, Inc., New York, N.Y. ; a part interest

[22] Filed: Apr. 15, 1975

[21] Appl. No.: 568,307

[52] U.S. Cl. ..... 272/70.3; 280/21 R

[51] Int. Cl.[2] ..... A61H 3/00

[58] Field of Search ..... 35/29 R, 29 C, 29 D, 35/29 E; 272/70, 70.3, 70.4; 280/16, 21 R; 297/5, 6

[56] References Cited

UNITED STATES PATENTS

| | | | |
|---|---|---|---|
| 16,150 | 12/1856 | Robbins | 272/70.3 |
| 265,432 | 10/1882 | Peterson | 272/70.3 |
| 320,462 | 6/1885 | Cowing | 272/70.3 |
| 923,556 | 6/1909 | Miller | 272/70.4 |
| 1,448,783 | 3/1923 | Blewitt | 272/70.3 X |

FOREIGN PATENTS OR APPLICATIONS

| | | | |
|---|---|---|---|
| 172,785 | 6/1906 | Germany | 272/70.4 |
| 67,335 | 1/1914 | Switzerland | 280/21 R |
| 182,853 | 5/1936 | Switzerland | 280/21 R |

*Primary Examiner*—Harland S. Skogquist
*Attorney, Agent, or Firm*—Joel Halpern

[57] ABSTRACT

A training device for ice skaters comprising a ring-like gripping member connected to the upper ends of a plurality of support legs. The lower ends of the support legs are secured to a pair of spaced parallel runners. A downwardly and forwardly-extending axially-resilient steering column is secured to the gripping member and carries a front runner which is rotatable to steer the device. The legs of the device are adjustable in length.

5 Claims, 4 Drawing Figures

TRAINING DEVICE FOR ICE SKATERS

BACKGROUND OF THE INVENTION

The present invention relates to training devices for ice skaters, and more particularly to a training device for young children.

Training devices for ice skaters have been known heretofore. One such device, which appears to most closely resemble the structure of the present invention, is shown in U.S. Pat. No. 320,462 issued June 23, 1885 to W. J. Cowing. According to this patent an appliance is provided which consists of uprights which support an open frame at their tops and bars or runners at their lower extremities. The skater fits within the open frame and can grip same for support. However, the device cannot be steered so that if the skater desires to change course, the device must be lifted and turned by the skater to the new direction of travel, with an attendant risk of loss in balance for the skater. Also, since the devices available heretofore were rigid structures substantially no protection was afforded the skater upon collision with a standing relatively immovable object.

SUMMARY OF THE INVENTION

It is one object of this invention to provide a training device for an ice skater, most desirably a child, which affords support for the skater and is steerable without having to be lifted for orientation to the new direction of travel.

It is another object of the invention to provide a training device for an ice skater, most desirably a child, which affords support for the skater, is steerable, and cushions the shock of a collision so as to minimize the risk of injury to the skater.

Other objects and advantages of the invention will become readily apparent from the following description.

According to the present invention there is provided a training device for ice skaters, comprising a plurality of generally vertical support legs, a horizontal body-enclosing rigid member secured to the upper ends of said support legs, a pair of horizontally-extending runners disposed in spaced parallel relation and secured to the lower ends of selected ones of said support legs, and a steering column secured to said body-enclosing member between said runners extending downwardly and forwardly, said steering column having a rotatable portion carrying a horizontally-extending front runner at the lowermost extremity thereof, said steering column being axially resilient, whereby rotation of said rotatable portion of the steering column selectively orients said front runner and establishes the direction of travel for said device.

BRIEF DESCRIPTION OF THE DRAWINGS

In order that the invention may be more fully understood it will now be described, by way of example, with reference to the accompanying drawings in which.

DETAILED DESCRIPTION OF THE DRAWINGS

Figure 1:
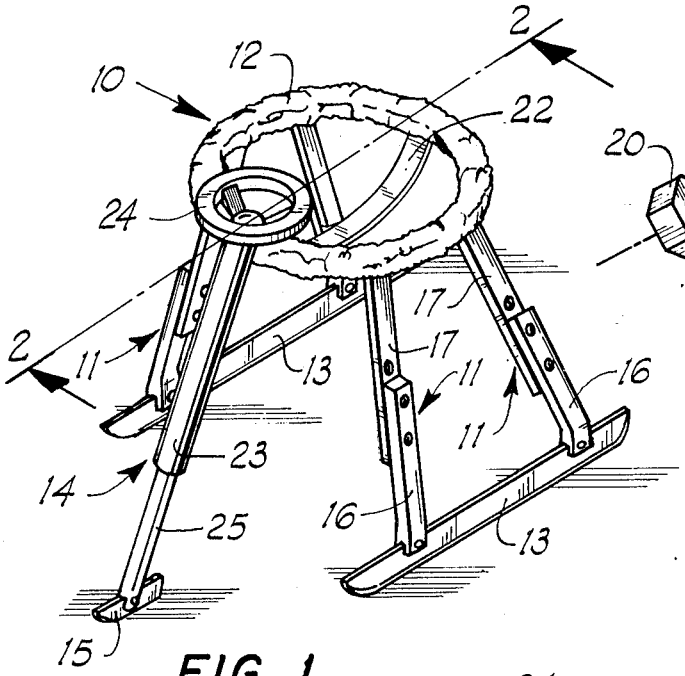
FIG. 1 is a perspective view of the training device of the invention.
Figure 4:
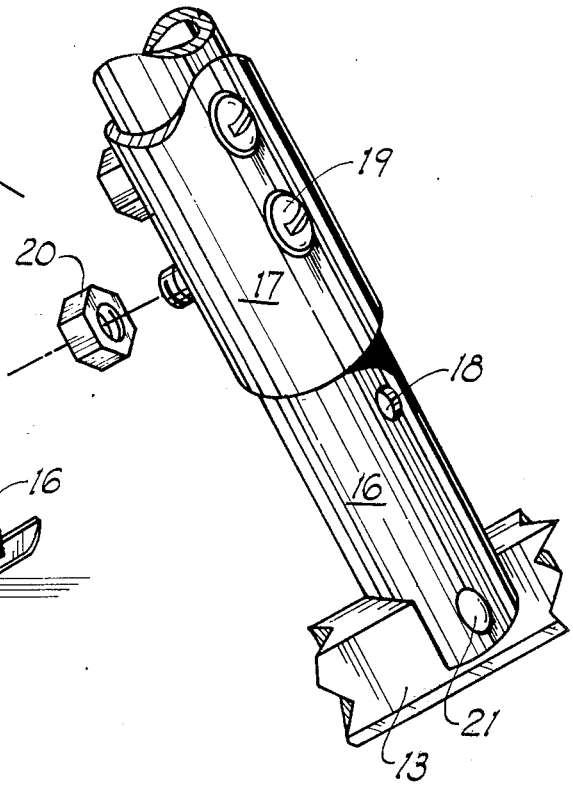
FIG. 4 is a fragmentary perspective view of a portion of a support leg.

Referring to the drawings there is shown the training device 10 consisting essentially of a plurality of support legs 11 which extend in a generally vertical direction, a horizontal body-enclosing rigid member 12 secured to the upper ends of the support legs, a pair of horizontally-extending runners 13 secured to the lower ends of the support legs in spaced parallel relation, and a steering column 14 secured to the front of the body-enclosing member and extending downwardly and forwardly thereof. The lower extremity of the steering column is provided with a front runner 15 which extends horizontally and is rotatable together with the portion of the steering column to which it is connected.

Figure 2:
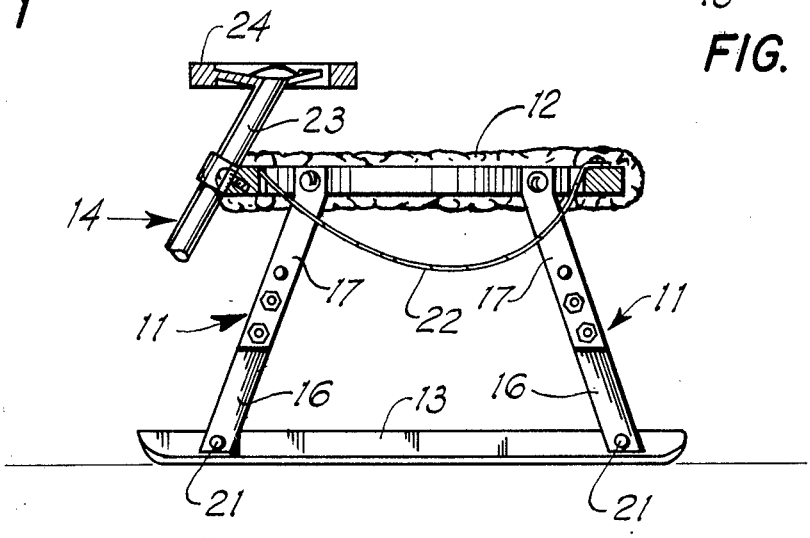
FIG. 2 is a cross-sectional view of the training device of FIG. 1 taken along line 2—2 of FIG. 1.

As may be seen from FIGS. 1 and 2, the support legs are preferably formed in two sections, a lower section 16 and an upper section 17. A series of axially-spaced apertures 18 are provided in at least one of such sections and fastening means such as bolts and nuts 19, 20 are cooperable with the apertures to detachably secure the upper and lower sections at a selected length. Thus, the overall height of the device may be adjusted as desired according to the height of the skater. This is an important feature of the invention since the device can be utilized as a training aid for children ranging from 1 to 6 years of age. Desirably the support legs are formed of a tubular material, and steel or aluminum are eminently satisfactory.

The runners may be connected to the lower extremities of the support legs by means of rivets 21 although it is conceivable that other conventional fastening means and expedients may be similarly employed. The use of galvanized steel runners is considered preferred but the selection of the material is not critical, however, the material should desirably exhibit a relatively low coefficient of friction.

The body-enclosing member 12 is shown as being of circular form and this is the preferred arrangement because it offers the greatest degree of protection against falling for a young skater. The diameter of the member should be large enough to accommodate the body of the skater. Also, the structural element forming the member may conveniently be padded such as with fur or a like soft material to minimize the transmission of cold to the hands of the skater during use of the device when contacted and also to act as a cushion in the event of a collision. So that the member 12 may also serve as a seat for the skater a detachable strap element 22 may be provided. The opposed ends of the strap element are secured to the member at opposed diametral locations.

Figure 3:
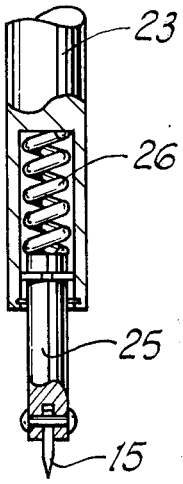
FIG. 3 is a fragmentary view, partly in cross-section and partly broken away, of the steering column.

As appears most clearly from FIGS. 1 and 3, a steering column 14 is shown as comprising two elements. The first of such elements is a hollow, longitudinally-extending housing 23 surmounted by steering means such as a wheel 24. The second element of the steering column is a rotatable rod 25 which is dimensioned to slidably fit within the housing 23. A spring 26 is positioned within the housing and bears upon a head of rod element 25 so as to bias the rod element outwardly of the housing. The horizontally-extending front runner 15 is secured to the lower extremity of the rod element. The steering means 24 is operably connected with the rotatable portion of the steering column in order to afford control of the front runner and thus enable the skater to steer the device in the desired direction. It will be appreciated, of course, that the rod element 25 need not be rotatable with respect to the housing but need only be slidable therewithin in order to provide a degree of resiliency which serves to absorb the shock of impact which may occur in the event the device collides with another vehicle or with a relatively immovable obstacle. In this manner the risk of injury to the skater, particularly when such skater is a young child, is minimized. In a construction of this type the steering wheel may be connected directly with the longitudinal housing of the steering column.

Although not shown it will be understood that a tow rope or the like may be secured to an appropriate location of either the steering column or the gripping member so as to enable the device to be pulled as by a parent in the process of teaching a child to skate.

For proper balance the steering column should be connected to the gripping ring at a location where it will be symmetrical with respect to the support legs and runners of the device.

From the foregoing description it will be seen that a training device for ice skaters has been provided which can be easily manipulated by the skater to establish any desired direction of travel without endangering the balance of the skater. The device through the resiliency of the steering column offers a high degree of safety to the skater in the event of a head-on collision. In having support legs capable of simple length adjustment the device may be readily adapted for use by children of various ages.

What is claimed is:

1. A training device for child ice skaters, comprising a plurality of generally vertical support legs, a horizontal body-enclosing rigid member secured to the upper ends of said support legs, a pair of horizontally-extending runners disposed in spaced parallel relation and secured fixedly to the lower ends of selected ones of said support legs, and a steering column secured to said body-enclosing member between said runners extending downwardly and forwardly, said steering column including a hollow longitudinally-extending housing and a rotatable steering element slidably mounted within said housing, a front runner secured to the lower extremity of said steering element which projects outwardly of the lower end of said housing, and spring means positioned within said housing adapted to bias said steering element outwardly from said lower end of said housing, whereby said steering column is longitudinally resilient and rotation of said steering element selectively orients said front runner and establishes the direction of travel for the training device.

2. A training device according to claim 1, wherein said body-enclosing member is circular and padded on the exterior surface thereof, a detachable strap element being secured at its opposed ends to said body-enclosing member at opposite diametral locations thereof.

3. A training device according to claim 1, wherein the said steering element is operably connected to manually movable steering control means for selective manual orientation of said front runner.

4. A training device according to claim 1, wherein each of said support legs is adjustable in length, each of said legs including an upper section and a lower section detachably secured, a series of axially-spaced apertures being provided in at least one of said upper and lower sections and fastening means cooperable with selected ones of said apertures to detachably secure said upper and lower sections of said legs.

5. A training device according to claim 4, wherein said support legs are formed of a tubular structural material.

* * * * *